United States Patent [19]

Nava

[11] Patent Number: 4,936,466

[45] Date of Patent: Jun. 26, 1990

[54] JEWELRY AND WATCH HOLDER

[76] Inventor: Jorge Nava, Avenida Luis Gonzalez #728, Chiclayo, Peru

[21] Appl. No.: 278,986

[22] Filed: Dec. 2, 1988

[51] Int. Cl.[5] ..... A47F 7/00

[52] U.S. Cl. ..... 211/13; 248/176; 206/566; 211/59.1

[58] Field of Search ..... 248/176, 121, 125, 116; 211/13, 59.1, 71, 125, 163, 57.1, 54.1, 205; 206/486, 487, 566

[56] References Cited

U.S. PATENT DOCUMENTS

| | | | |
|---|---|---|---|
| 1,327,581 | 1/1920 | Yeats | 211/163 X |
| 1,542,672 | 6/1925 | Crapo | 248/116 |
| 1,548,717 | 8/1925 | Hall | 248/121 |
| 2,113,038 | 4/1938 | Thalinger | 211/13 X |
| 3,456,579 | 7/1969 | Woods | 211/163 X |
| 3,997,050 | 12/1976 | Patterson | 211/163 X |
| 4,058,356 | 11/1977 | Michal | 211/163 X |
| 4,129,216 | 12/1978 | Schick | 211/13 |
| 4,390,099 | 6/1983 | Trautlein et al. | 211/13 X |
| 4,534,471 | 8/1985 | Zahn et al. | 211/163 X |

FOREIGN PATENT DOCUMENTS

| | | | |
|---|---|---|---|
| 41677 | 11/1973 | Australia | 211/13 |
| 2069331 | 8/1981 | United Kingdom | 211/13 |
| 2181049 | 4/1987 | United Kingdom | 211/13 |
| 2201086 | 8/1988 | United Kingdom | 211/13 |

*Primary Examiner*—David M. Purol

*Attorney, Agent, or Firm*—Jesus Sanchelima

[57] ABSTRACT

A holder for jewelry items and watches that includes illumination and upwardly mounted support member for storing and displaying these items. A base with a flat surface is provided to provide structural integrity to the structure while at the same time houses the batteries and/or wires that provide the electrical energy to the holder's illuminating device. A horizontal support member is disposed so that it includes a bend where the watches' straps are positioned thereby securing them in place. Also, a hook member is rigidly mounted to the underside of the horizontal member so that other jewelry items can be suspended from it. One or more frustoconical members are rigidly mounted to the vertical support members thereby providing the member for receiving and holding in place rings and other cooperating jewelry items.

5 Claims, 1 Drawing Sheet

JEWELRY AND WATCH HOLDER

BACKGROUND OF THE INVENTION

1. Field of the Invention

The present invention relates to holders for jewelry, and more particularly, to those holders that are electrically illuminated.

2. Description of the Related Art

Typically, when a person returns to his home, he or she takes off his jewelry and watch. A jewelry holder provides a central place for storing it. In most instances, jewelry holders in use today have been jewelry boxes where you cannot see the contents. You actually have to physically go to the jewelry box and open it to determine whether the desired items are there. The items stored in the jewelry box are not infrequently scratched.

Applicant believes that the closest reference corresponds to U.S. Pat. No. 1,542,672 issued to G. B. Crapo. However, it differs from the present invention because if only provides support for watches and conceivably for bands and bracelets but not for rings and other items of jewelry. Also, it does not provide for illumination of the items it contains.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a jewelry holder that is capable of storing and displaying a multitude of items while at the same time provides for means illuminating them and, in particular, capable of illuminating the face of a watch suspended there so that a user can tell what time it is.

It is another object of this present invention to provide an aesthetically appealing jewelry holder that requires a minimum of maintenance.

It is yet another object of this present invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
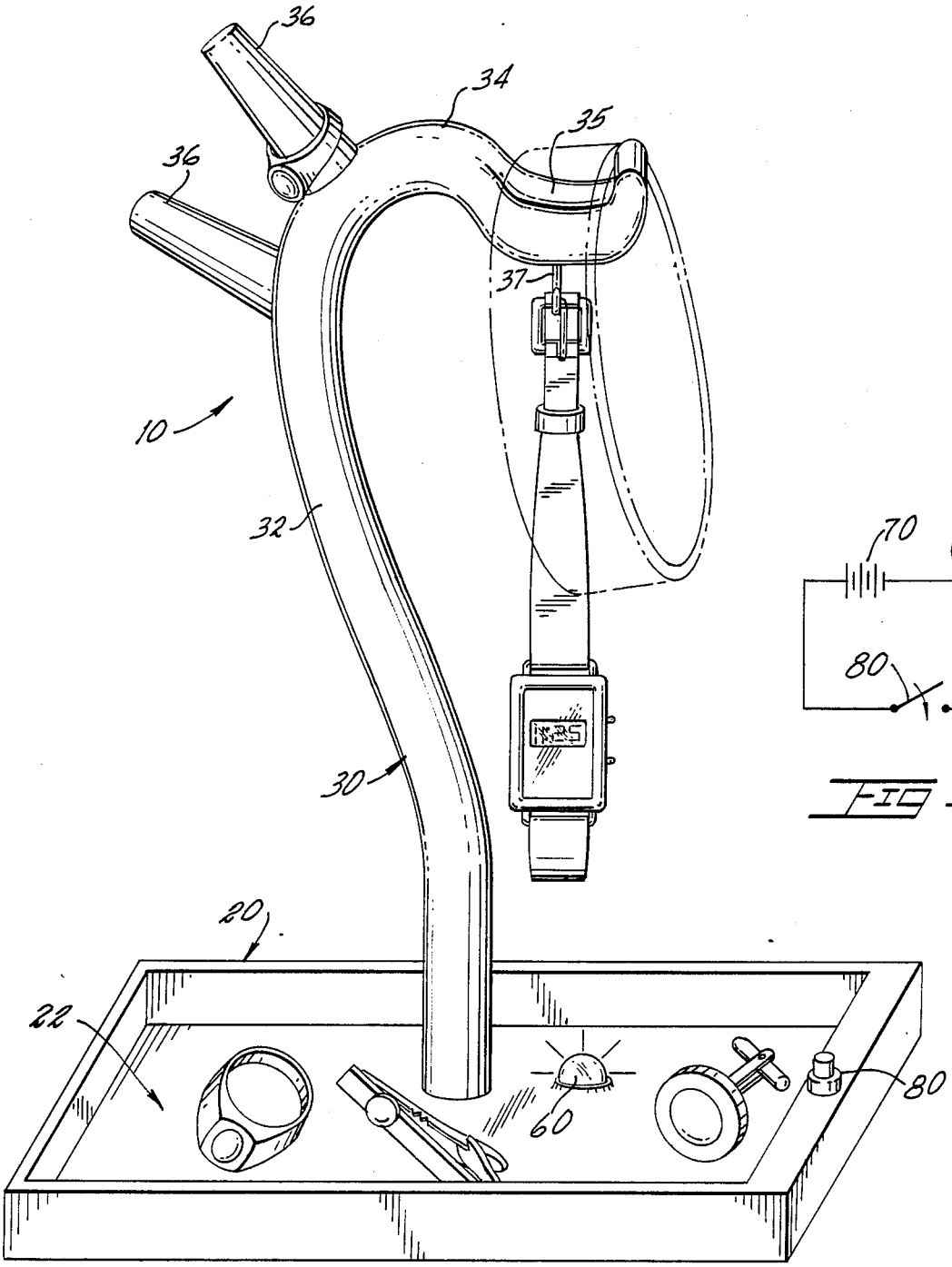
FIG. 1 represents the jewelry holder incorporating the subject of the present invention.
Figure 2:
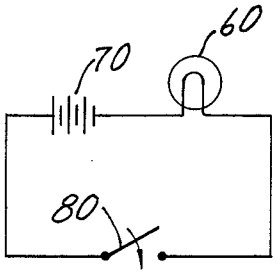
FIG. 2 shows the circuit diagram used in the preferred embodiment for powering the illuminating device incorporated in the present invention.

Referring now to FIG. 1, where the present invention is generally referred to with numeral 10, it can be observed that it basically includes base member 20 and an upwardly mounted support member 30. The items of jewelry suspended or placed in holder 10 are representative of common items for which holder 10 is used.

Base member 20, in the preferred embodiment, includes a trough 22 that could have any of a multitude of shapes provided that the overall effect of base member 20 is to provide the necessary structural stability for vertically mounted support member 30 which is rigidly mounted to the upperside of member 20. Support member 30 includes a vertical support member 32, a horizontal support member 34 and at least one pin member 36 which has preferably a frustoconical shape. Vertical support member 32 is rigidly mounted at its lower end to the upperside of base member 20 and it extends upwardly a sufficient distance to allow watches and other items to be suspended in the air by cooperating horizontal support member 34. Horizontal support member 34 extends substantially radially outwardly and it is preferably provided with a bent area 35 where the bands of watches, bracelets or similar items are positioned. Also, hook members 37 can be mounted to the underside of horizontal support member 34 so that similar items can be suspended from it. This facilitates finding them when needed and also provides an attractive way of displaying these jewels and watches.

A light bulb member 60 is preferably mounted on the upperside of base member 20 and it is connected in series with battery assembly 70 and switch 80. Switch 80 is preferably a push button type. Light bulb member 60 is positioned so that it provides sufficient light to illuminate the face of a watch suspended in holder 10 so that a user can see what time it is without needing to turn on a lamp. This is desirable when the user sleeps with other persons and does not want to bother them.

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense.

What is claimed is:

1. A holder for jewelry items, including rings and watches, comprising:

A. a base member having an upperside and a flat underside resting in a horizontal plane;

B. supporting means including an upwardly extending elongated support member having an upper and a lower end and said lower end being rigidly mounted to said upperside and said supporting means further including a substantially horizontal support member that is rigidly mounted to said upwardly extending elongated support member substantially towards said upper end so that said watches can be suspended from said horizontal support member and displayed;

C. at least one pin member substantially radially mounted to said upwardly extending elongated support member and slightly at an upwardly angle from the horizontal plane so that said pin member can receive said rings and keep them in place; and D. illuminating means positioned on the upperside of said base member so that said jewelry items can be illuminated and further including means for electrically powering said illuminating means and wherein said illuminating means further includes switch means connected in series with said means for electrically powering said illuminating means so that the latter can be selectively turned on and off and wherein said horizontal support member includes an underside and a hook member that is rigidly mounted to said underside so that cooperating jewelry items can be suspended from said hook member and wherein said base member includes a trough on its upperside so that said jewelry items can be housed therein and wherein said horizontal support member includes a bent section that provides a suitable area for hanging said watches and other cooperating jewelry items.

2. The holder set forth in claim 1 wherein said means for electrically powering said illuminating means includes battery means.

3. The holder set forth in claim 2 wherein said illuminating means are positioned so that said watch is sufficiently illuminated that a user can see what time it is.

4. The holder set forth in claim 3 wherein said switch means includes a push button switch.

5. The holder set forth in claim 4 wherein said pins have a frustoconical shape.

* * * * *